United States Patent [19]

Broder

[11] 4,094,048

[45] June 13, 1978

[54] METHOD OF HEAT FORMING OF WORKPIECES

[75] Inventor: Gerhard Broder, Dusseldorf, Germany

[73] Assignee: Franz Berrenberg, Haan, Germany

[21] Appl. No.: 742,646

[22] Filed: Nov. 17, 1976

[30] Foreign Application Priority Data

Sep. 25, 1976 Germany ..... 2643340

[51] Int. Cl.[2] ..... B21K 1/08

[52] U.S. Cl. ..... 29/6; 72/342

[58] Field of Search ..... 29/6; 72/342, 377

[56] References Cited

U.S. PATENT DOCUMENTS

| | | | |
|---|---|---|---|
| 718,422 | 1/1903 | Brophy | 29/6 X |
| 1,717,513 | 6/1929 | Larcher | 29/6 |
| 2,415,212 | 2/1947 | Leake | 72/377 X |
| 2,535,295 | 12/1950 | Lafont | 29/6 |
| 2,653,373 | 9/1953 | Brauchler | 29/6 |
| 3,035,341 | 5/1962 | Frank et al. | 72/377 X |
| 3,129,488 | 4/1964 | Robra et al. | 29/6 |
| 3,198,928 | 8/1965 | Allison | 72/342 X |
| 3,867,832 | 2/1975 | Rut | 29/6 |

*Primary Examiner*—Horace M. Culver
*Attorney, Agent, or Firm*—Martin A. Farber

[57] ABSTRACT

A method for hot metal forming of workpieces with at least two secondary adjacent form elements lying non-symmetrically to the axis of the main form element and slightly spaced from each other, particularly for the manufacture of crankshafts, whereby a rod-shaped starting material is warmed in the range of the secondary adjacent form elements to be formed thereon and a material bulging accumulation is produced in common for all of the adjacent form elements by means of an axial upsetting or compression. The adjacent form elements are shaped by drop-forging with a spacing from one another which is enlarged with respect to the final form, and after the flash trimming of the latter intermediate shape, the final form is produced by compression of the form part which lies between the secondary adjacent form elements with a simultaneous calibration of the final spacing.

3 Claims, 9 Drawing Figures

A

B 1
1
2
2
C
4
3
VI
VI 2
4
3

VIII
IX
VII
C
D
E
F

METHOD OF HEAT FORMING OF WORKPIECES

The present invention relates to a method for heat forming of workpieces with at least two secondary form elements lying unsymmetrical to the axis of the main form element and slightly spaced from one another and particularly for the manufacture of crankshafts.

During the heat deforming or shaping of workpieces with at least two secondary form elements which lie unsymmetrically relative to the axis of the main form element, with the known methods for non-cutting or forging, a finishing operation is only possible if the secondary form elements are sufficiently spaced from one another. This spacing makes it possible during forging of the workpiece to provide a wedge or key shaped elevation or projection between the drop or forged parts forming the secondary elements, the dimensions of which correspond to the space between the secondary form elements. If this distance however exceeds a degree which is dependent on the material of the forging die, with the known methods it is necessary to forge the secondary form elements continuously or joined together and to produce the intermediate space which is required for the final form between the secondary form elements by means of a stock chip or cutting removal operation. With a crankshaft, whose main form elements are the shaft journals and whose secondary form elements which are non-symmetrically disposed thereto are the crankwebs or arms which are formed also as counterweights, this means that the material lying between the crankwebs must be worked out or roughed out by cutting or machining after the forging process. In this manner a costly machining or cutting is necessary for the inner sides of the crankwebs up to the crankpin connecting the crankwebs, which mechanically has only free measure tolerances or untoleranced dimensions.

The known methods for heat deformation of workpieces, which require an additional chip or cutting removal operation due to the secondary form elements lying at a small spacing from one another, not only have the disadvantage however that after the heat shaping the workpiece must be subjected to an additional operational process with the therefor required clamping-, alignment- and transport- processes, but rather also destroy the run of the fibre or grain of the workpiece by the cutting or machining work, which is of great significance for the solidarity- or firmness- characteristics.

Accordingly it is an object of the present invention to provide a method for heat deforming of workpieces with at least two secondary (i.e., adjacent) form elements which lie spaced at a small distance from each other and non-symmetrically relative to the axis of the main form elements, which makes possible the production of the final form of the workpiece without breaking or interrupting the run of the fibre or grain and without the necessity of a chip or cutting removal working operation. For the production of crankshafts this is significant also in that crankshafts are supposed to be produced exclusively by heat deformation with small space between the crankarms.

It is another object of the present invention to aid in the solution of the above-mentioned object in the manner that a rod-shaped starting material is warmed in the range of the adjacent secondary form elements to be formed thereon and a material accumulation or bulging concentration is produced in common for all adjacent secondary form elements by means of an axial upsetting or compression, that the adjacent or secondary form elements are shaped by drop-forging with a spacing from one another which is enlarged with respect to the final form, and that after the flash trimming of the latter intermediate shape, the final form is produced by compression of the form part which lies between the adjacent or secondary elements with simultaneous calibration of the final defined spacing.

Starting out from a rod or bar shaped starting material which is upset or compressed in the axial direction after a warming for the formation of the material massing or accumulation required for the forging of the secondary (adjacent) form elements, the method in accordance with the present invention avoids the chip or machining removal operation as well as the therewith connected destroying of the run of the fiber or course of the grain, in the manner that the secondary form elements are drop-forged with a spacing from one another which is enlarged relative to the final condition, so that the limitation or restriction existing with the heretofore known methods which arises with too small a spacing between the secondary form elements is eliminated. The drop-forging is thus possible, under observation and maintenance of the required dimensions of the drop-forging die, for any type of workpiece, since the intermediate shape of the workpiece which is produced after the drop-forging no longer need be held to the final spacing between the secondary adjacent form elements. After the flash trimming of this intermediate form, the form part which lies between the adjacent secondary elements is compressed and simultaneously the final spacing between the secondary elements for the final workpiece shape is produced by means of calibration. Altogether in this manner the workpiece is produced by means of hot workability or heat shaping or a rod-shaped starting material in spite of a small distance between the adjacent secondary form elements. The run or course of the grain in the workpiece during the method in accordance with the present invention is neither broken, interrupted, nor cut, so that the workpieces produced according to the methods of the present invention, not only may be produced economically and particularly fast, but also possess good firmness and solidarity strength characteristics.

According to a further feature of the invention, the regional heating of the starting material and the axial squeezing or upsetting of the material massing accumulation can be carried out on an electrical-compressing or upsetting machine, the heat supply or feed thereof being sufficient at the same time for the drop-forging, heat deburring or flash trimming as well as the compressing and calibrating of the adjacent form elements. In this manner an energy savings is achieved, which comes up to the material- and energy- economization, which with respect to the known methods is obtained with the main proposal of the present invention. In an advantageous feature the drop-forging is carried out on a friction wheel-crew driven press. The compression of the form part which lies between the adjacent secondary elements as well as the simultaneous calibration of the final spacing between the secondary elements can be carried out in accordance with the present invention with the use of a floating graduation saddle, whereby with simple means the observation and maintenance of small tolerances are achieved concerning the final shape of the workpiece.

With the above and other objects and advantages in view, the present invention will become more clearly understood in connection with the following detailed description of a preferred embodiment, when considered with the accompanying drawings, of which:

Figures 1, 2, 3, 6:
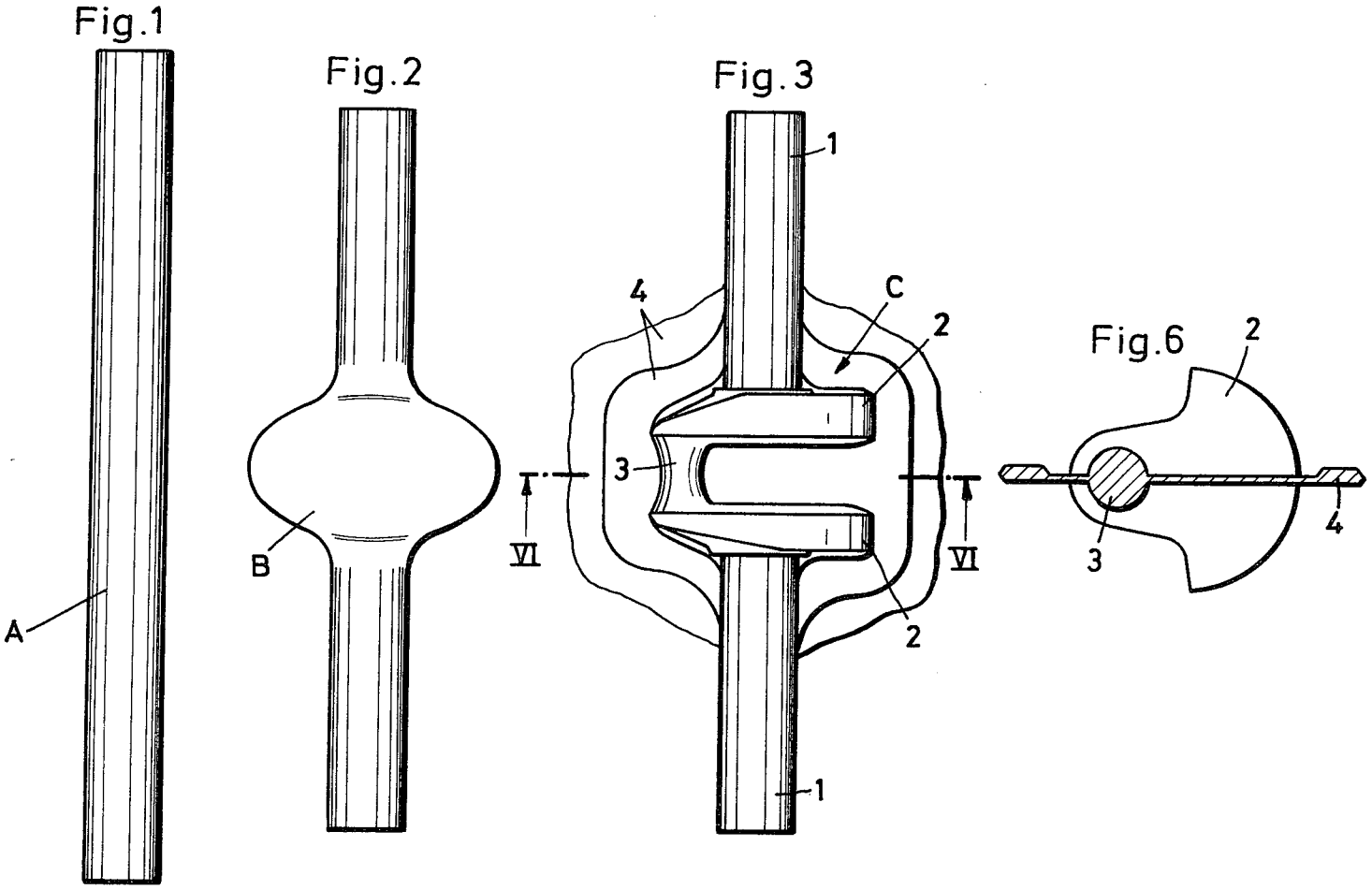
FIG. 1 is a side view of a rod-shaped starting material.
FIG. 2 is a similar view illustrating an intermediate step with squeezed material accumulation or bulging.
FIG. 3 is a further intermediate stage of the process showing the workpiece after the drop-forging.
FIG. 6 is a cross-section along the lines VI—VI of FIG. 3.

An example selected for explanation of the method in accordance with the present invention of a workpiece is a crankshaft, which particularly is determined for a one cylinder combustion engine and therefore is provided with an eccentrically offset crankpin between the two shaft journals, which crankpin extends between two crankwebs or arms. These crankwebs are also formed as counterweights and they accordingly form relative to the shaft journals which constitute the main form elements, non-symmetrically arranged adjacent secondary form elements. These secondary form elements lie slightly spaced from one another, because the crankpins only have a small axial extent.

Referring now to the drawings, this crankshaft is made from a rod shaped starting material A, which in the embodiment example has a circular shaped cross-section and which was severed with a predetermined length from a longer rod. The starting material can constitute a rolled starting material for example a specific steel alloy.

In an electro-pressing or upsetting machine, the starting material A is heated in the center, that is it is regionally heated in the illustrated embodiment example and is compressed or squeezed in the axial direction, so that a material massing or accumulation B bulges out in the center according to FIG. 2, which bulging B is formed substantially rotationally symmetric relative to the longitudinal axis. This intermediate stage of the workpiece now is drop-forged in a die of a friction disc-crew-driven press so that the intermediate shape C according to FIG. 3 is produced.

Figures 4, 5, 7, 8, 9:
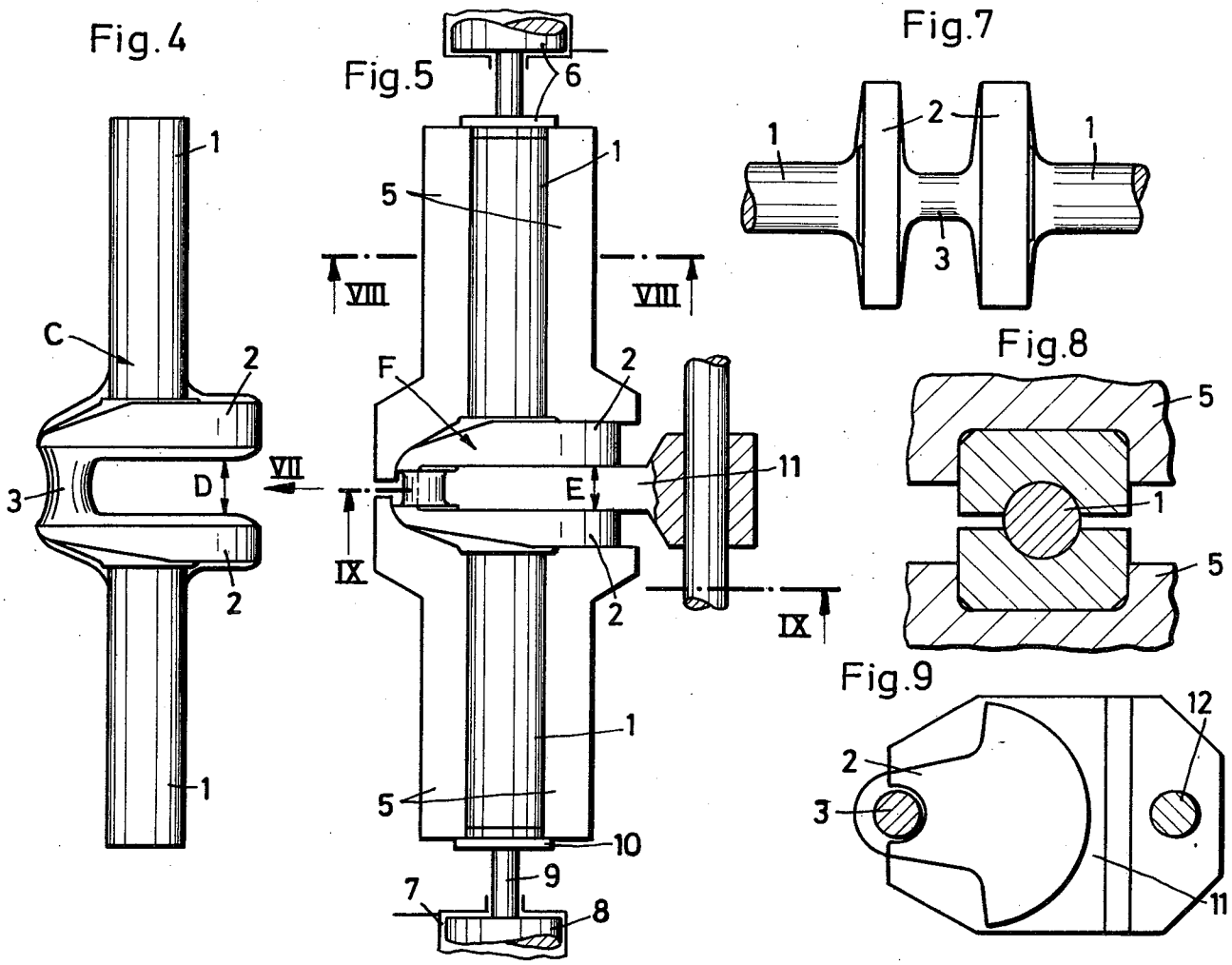
FIG. 4 is a similar view showing the intermediate form of the workpiece produced with the drop-forging after the deflashing.
FIG. 5 shows another stage of the process of the compression of the intermediate form according to FIG. 4 and simultaneous calibration of the final spacing.
FIG. 7 is a side view in the direction of the arrow VII of FIG. 4.
FIG. 8 is a partially broken away sectional view taken along the lines VIII—VIII of FIG. 5 showing the clamping of the workpiece during the compression according to FIG. 5.
FIG. 9 is a cross-section taken along the lines IX—IX of FIG. 5.

By this intermediate shape C, the future shaft journals of the crankshaft form the main form elements 1. At right angles to the latter and unsymmetrically to the axis of the same, there lies the adjacent secondary form elements 2 (the latter forming the crankarms or webs with counterweights), between which there extends a form part 3 which forms the future or subsequent crankpin. These parts are surrounded by a flash 4, which is formed by the excess material which exits during the drop-forging in the separation plane between the lower part and the upper part of the forging die. This flash 4 is removed during the next working step. FIG. 4 shows the deburred or trimmed intermediate shape C.

It also may be gathered from this illustration that the secondary form elements 2 during the production of the intermediate shape C by the drop-forging have an enlarged spacing D compared to the final shape, the measure of which is determined by the conditions or specifications of the drop-forging process. The final spacing E, which is provided with the end form F of the workpiece according to FIG. 5, is marked in FIG. 5.

This final spacing E between the secondary form elements 2 of the workpiece is attained by an axial compression of the form part 3 which lies between the secondary form elements 2, as schematically illustrated in FIG. 5. For this purpose the workpiece is gripped or clamped in the range of the main form elements 1 by means of divided clamping jaws 5. The axial compression takes place for example against a positive stop 6 by means of a pressure medium cylinder or hydraulic cylinder 7, the piston 8 of which is connected by means of a piston rod 9 with a carrier or support 10 for the divided clamping jaws 5.

During the axial compression of the form part 3, simultaneously there occurs a calibration of the final spacing E by means of a gauging or descent plate 11, which is mounted floating on a guide rod 12, the latter extending parallel to the longitudinal axis of the workpiece.

As far as the heat supply or feed to the rod shaped starting material A is chosen sufficiently large for the purpose of making the material enlargement or concentration B by means of the axial compression, the subsequent drop-forging as well as the compressing of the form part 3 and calibration of the final distance E can be carried out with use of the heat delivered or fed in the electro-upsetting machine, so that the process can be carried out with a small energy consumption and in the shortest time. It is of course also possible to produce crankshafts with a plurality of crankpins which are offset relative to one another and corresponding to a plurality of secondary form elements as well as other workpieces which are equipped with secondary form elements which lie nonsymmetrically to the axis of the main form element.

While I have disclosed one embodiment example of the present invention, this embodiment is given by example only and not in a limiting sense.

I claim:

1. A method for heat shaping of workpieces with at least two secondary form elements lying nonsymmetrically to the axis of the main form elements and spaced slightly from one another, particularly crankshafts, comprising the steps of heating rod shaped starting material in the range of secondary elements to be formed thereon, axially compressing the heated rod shaped starting material and producing one enlarged material concentration in common for all secondary form elements which subsequently are to be produced, drop-forging the material concentration and producing the two secondary form elements axially spaced from one another by an enlarged spacing relative to a final form and final spacing to be produced, forming an intermediate shape having the secondary form elements connected by an integrally adjoining necked down form part, trimming the intermediate shape, axially compressing the adjoining necked down form part lying between the secondary form elements into a final enlarged cylindrical shape with simultaneous calibration of the final spacing between the secondary form parts, thereby producing the final form and final spacing, performing the compressing of the adjoining necked down form part lying between the secondary form elements as well as the simultaneous calibration of the final spacing between the secondary form parts by inserting a floating gauging saddle therebetween and axially compressing the main form elements.

2. The method in accordance with claim 1, further comprising the step of performing the heating of the starting material and the axial compression of the material concentration on an electrical upsetting machine, using the heat supply of the electrical upsetting machine together for the drop-forging, trimming as well as compressing and calibrating operations.

3. The method according to claim 1, further comprising the step of performing the drop-forging on a friction wheel crew-driven press.

* * * * *